US011009258B2

(12) United States Patent
Jeong et al.

(10) Patent No.: US 11,009,258 B2
(45) Date of Patent: May 18, 2021

(54) AIR CONDITIONER

(71) Applicant: LG ELECTRONICS INC., Seoul (KR)

(72) Inventors: Hojong Jeong, Seoul (KR); Kakjoong Kim, Seoul (KR); Wooho Cha, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 129 days.

(21) Appl. No.: 16/267,543

(22) Filed: Feb. 5, 2019

(65) Prior Publication Data

US 2019/0242617 A1 Aug. 8, 2019

(30) Foreign Application Priority Data

Feb. 5, 2018 (KR) ..... 10-2018-0013806

(51) Int. Cl.
*F24F 13/30* (2006.01)
*F24F 11/41* (2018.01)
(Continued)

(52) U.S. Cl.
CPC ..... *F24F 13/30* (2013.01); *F24F 1/0063* (2019.02); *F24F 3/065* (2013.01); *F24F 11/41* (2018.01); *F24F 11/84* (2018.01)

(58) Field of Classification Search
CPC .. F24F 11/41; F24F 13/30; F24F 11/84; F24F 3/065; F24F 1/0063; F24F 1/26; F25B 47/022; F25B 2313/006; F25B 2313/02522; F25B 2313/02532; F25B 2313/0251; F25B 39/028; F25B 41/046; F25B 41/003; F25B 47/02; F28F 1/00; F28F 9/0275; F28F 2250/06; F28F 9/027; F28F 27/02
See application file for complete search history.

(56) References Cited

U.S. PATENT DOCUMENTS

2010/0170270 A1* 7/2010 Jang ..... F25B 47/022 62/81
2010/0293980 A1* 11/2010 Shimaoka ..... F25B 39/028 62/259.1

(Continued)

FOREIGN PATENT DOCUMENTS

DE 3005794 A1 * 8/1981 ..... F25B 30/02
JP 52-56432 5/1977

(Continued)

OTHER PUBLICATIONS

International Search Report dated May 17, 2019.

*Primary Examiner* — Frantz F Jules
*Assistant Examiner* — Martha Tadesse
(74) *Attorney, Agent, or Firm* — KED & Associates LLP

(57) ABSTRACT

An air conditioner includes a plurality of heat exchangers provided to form an internal refrigerant flow path of an outdoor heat exchanger in multiple stages, a bypass pipe configured to branch refrigerant discharged from a compressor and to guide the refrigerant to the plurality of heat exchangers, flow pipes branched from the bypass pipe and extending to refrigerant pipes provided in the plurality of heat exchangers and overlap pipes branched from a flow pipe connected to any one of the plurality of heat exchangers and extending to a flow pipe connected to another heat exchanger.

20 Claims, 3 Drawing Sheets

(51) Int. Cl.

| | |
|---|---|
| ***F24F 11/84*** | (2018.01) |
| ***F24F 3/06*** | (2006.01) |
| ***F24F 1/0063*** | (2019.01) |

(56) References Cited

U.S. PATENT DOCUMENTS

| | | | | |
|---|---|---|---|---|
| 2012/0118533 | A1* | 5/2012 | Jang | F25B 41/003 165/96 |
| 2013/0192809 | A1* | 8/2013 | Kim | F28F 1/00 165/175 |
| 2016/0033179 | A1* | 2/2016 | Kim | F24F 1/30 62/324.6 |
| 2016/0123645 | A1* | 5/2016 | Kim | F25B 49/02 62/115 |
| 2017/0153050 | A1* | 6/2017 | Nakagawa | F25B 47/025 |

FOREIGN PATENT DOCUMENTS

| | | | | |
|---|---|---|---|---|
| JP | 08-261691 | | | 10/1996 |
| JP | 08261691 | A | * | 10/1996 |
| JP | 09-318206 | | | 12/1997 |
| JP | 09318206 | A | * | 12/1997 |
| JP | 2000018734 | A | * | 1/2000 |
| JP | 2011202875 | A | * | 10/2011 |
| KR | 10-2000-0075158 | | | 12/2000 |
| KR | 10-2010-0081621 | | | 7/2010 |
| KR | 10-2013-0096960 | | | 9/2013 |
| KR | 20130102219 | A | * | 9/2013 |
| KR | 101401909 | B1 | * | 5/2014 |
| KR | 20150029987 | A | * | 3/2015 |

* cited by examiner

AIR CONDITIONER

CROSS-REFERENCE TO RELATED APPLICATION(S)

The present application claims the benefit of priority under 35 U.S.C. 119 and 35 U.S.C. 365 to Korean Patent Application No. 10-2018-0013806, filed in Korea on Feb. 5, 2018, the contents of all of which are hereby incorporated by reference in their entireties.

BACKGROUND

1. Field

The present invention relates to an air conditioner.

2. Background

An air conditioner is an apparatus for keeping air in a predetermined space in a most suitable condition according to purpose. In general, the air conditioner includes a compressor, a condenser, an expansion device and an evaporator, and a refrigerant cycle for compressing, condensing, expanding and evaporating refrigerant may be driven to cool or heat the predetermined space.

The predetermined space may be variously proposed according to place where the air conditioner is used. For example, when the air conditioner is placed in the home or office, the predetermined space may be an indoor space of a house or a building.

When the air conditioner performs cooling operation, an outdoor heat exchanger provided in an outdoor unit performs a condenser function and an indoor heat exchanger provided in an indoor unit performs an evaporator function.

In contrast, when the air conditioner performs heating operation, the indoor heat exchanger performs a condenser function and the outdoor heat exchanger performs an evaporator function. In the heat exchanger, the flow directions of the refrigerant at the time of cooling and heating operations are opposite to each other.

In the heating operation, since the refrigerant flowing in the outdoor heat exchanger sucks heat and evaporates, the surface temperature of the outdoor heat exchanger is lowered. Accordingly, frost may be formed on the surface of the outdoor heat exchanger and thus heat exchange efficiency may be decreased. Therefore, the air conditioner performs defrosting operation for removing the frost on the surface of the outdoor heat exchange in the heating operation.

Meanwhile, in order to improve heat exchange efficiency, the air conditioner may allow the refrigerant to pass through the outdoor heat exchanger in series or in parallel according to the cooling operation or the heating operation.

Information on the related art is as follows.

1. Publication No. (Publication Date) 10-2013-0096960 (Sep. 2, 2013)

2. Title of the Invention: Air conditioner

However, the air conditioner disclosed in the related art has the following problems.

First, when defrosting operation is performed, since a refrigerant circulation direction is switched from a heating cycle to a cooling cycle and defrosting of an outdoor heat exchanger is performed, an indoor unit operates as an evaporator and thus an inside temperature is lowered, that is, cold draft occurs.

In particular, when defrosting operation is performed during heating operation, since some indoor units operate as evaporators, heating performance may not reach 40%. As a result, since heating performance desired by a user may not be achieved, reliability is low.

Second, in an outdoor heat exchanger including a plurality of heat exchangers stacked in multiple stages, frost may be formed on an interface between a heat exchanger for performing defrosting operation and a heat exchanger adjacent thereto due to a difference in temperature between the heat exchangers.

Specifically, since the heat exchanger for performing defrosting operation operates as a condenser and the heat exchanger adjacent thereto operates as an evaporator, the difference in temperature between the heat exchanger for performing defrosting operation and the heat exchanger adjacent thereto may be large. Accordingly, a frost band is formed on the interface between the heat exchanger for performing defrosting operation and the heat exchanger adjacent thereto.

BRIEF DESCRIPTION OF THE DRAWINGS

Embodiments will be described in detail with reference to the following drawings in which like reference numerals refer to like elements, and wherein.

DETAILED DESCRIPTION

Reference will now be made in detail to the embodiments of the present disclosure, examples of which are illustrated in the accompanying drawings.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense.

Also, in the description of embodiments, terms such as first, second, A, B, (a), (b) or the like may be used herein when describing components of the present invention. Each of these terminologies is not used to define an essence, order or sequence of a corresponding component but used merely to distinguish the corresponding component from other component(s).

Figure 1:
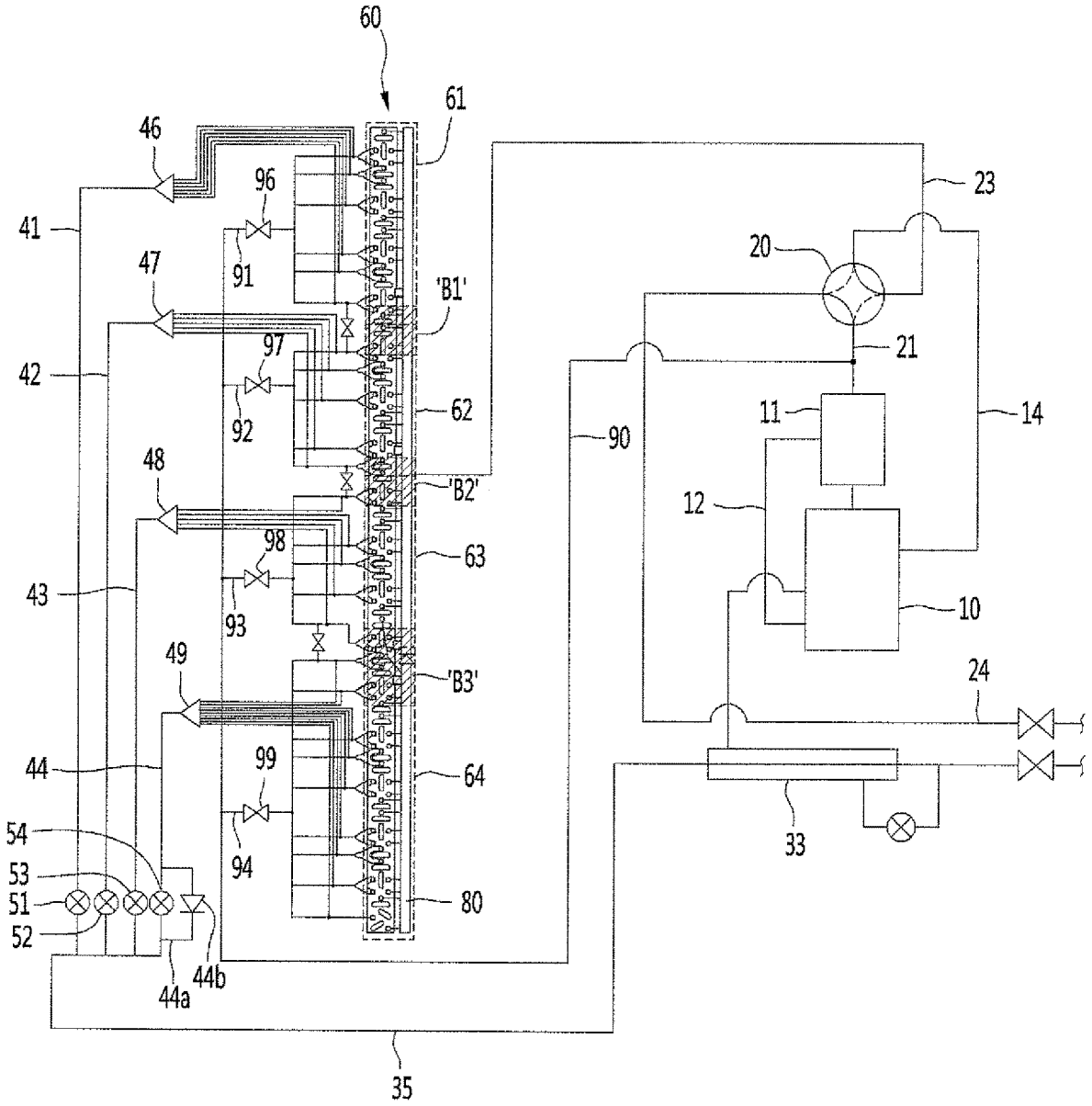
FIG. 1 is a schematic view showing the configuration of an air conditioner according to an embodiment of the present invention.
Figure 2:
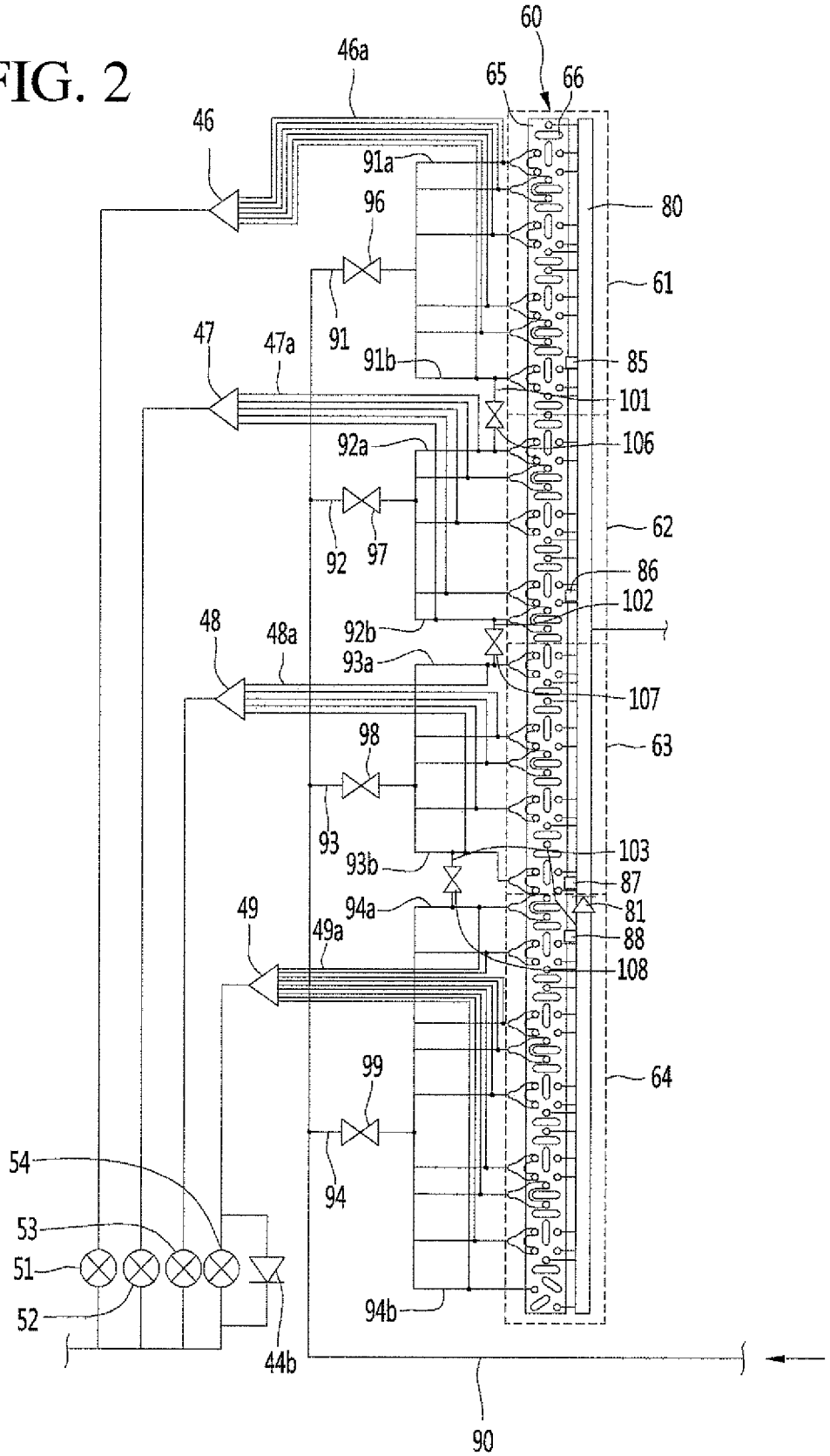
FIG. 2 is a view showing an outdoor heat exchanger of the air conditioner according to the embodiment of the present invention.

FIG. 1 is a schematic view showing the configuration of an air conditioner according to an embodiment of the present invention, and FIG. 2 is an enlarged view showing an outdoor heat exchanger of the air conditioner according to the embodiment of the present invention.

Referring to FIGS. 1 and 2, the air conditioner according to the embodiment of the present invention may include a compressor 10 for compressing refrigerant and an oil separator 11 for separating coil of the refrigerant discharged from the compressor 10.

The oil separator 11 is connected to the outlet of the compressor 10 to suck the compressed refrigerant. The refrigerant compressed at a high temperature and high pressure in the compressor 10 passes through the oil separator 11, thereby separating and returning oil.

The oil separator 11 may include an oil return line 12 for returning the separated oil to the compressor 10. The oil return line 12 may be connected to the inlet of the compressor 10.

An accumulator (not shown) may be connected to the inlet of the compressor 10. The accumulator may receive and separate evaporated refrigerant into liquid refrigerant and gaseous refrigerant.

The accumulator may be provided in a suction pipe 14 provided on the inlet of the compressor 10.

The air conditioner may further include a flow switching unit 120 for switching the flow direction of the refrigerant, an outdoor heat exchanger 60 for exchanging heat with outside air, an indoor heat exchanger (not shown) for heating and cooling an indoor space, and expansion valves 51, 52, 53 and 54 for depressurizing refrigerant.

The flow switching unit 20 may include a four-way valve for switching the flow direction of the refrigerant.

The indoor heat exchanger (not shown) performs heat exchange between inside air and refrigerant and may operate as an evaporator or a condenser according to operation mode. Therefore, it is possible to cool or heat the indoor space.

Each of the expansion valves 51, 52, 53 and 54 may include an electronic expansion valve (EEV).

The outdoor heat exchanger 60 may include a plurality of heat exchangers 61, 62, 63 and 64 to form an internal refrigerant flow path in multiple stages. The plurality of heat exchangers 61, 62, 63 and 64 may be stacked in multiple stages and may be integrally formed. For example, in the outdoor heat exchanger 60, four heat exchangers 61, 62, 63 and 64 may form a four-stage refrigerant flow path.

The refrigerant flow path forming a single stage may be defined as a flow path of refrigerant flowing from one of distributors 46, 47, 48 and 49. In addition, the refrigerant flow path forming a single stage may form a plurality of refrigerant flow paths in the heat exchangers 61, 62, 63 and 64.

In the embodiment of the present invention, assume that the outdoor heat exchanger 60 includes four heat exchangers 61, 62, 63 and 64. In this case, it is possible to provide appropriate heating capacity (75% or more) to a user while performing defrosting operation.

The outdoor heat exchanger 60 may include the first heat exchanger 61, the second heat exchanger 62 located below the first heat exchanger 61, the third heat exchanger 63 located below the second heat exchanger 62 and the fourth heat exchanger 64 located below the third heat exchanger 63.

That is, the first heat exchanger 61 to the fourth heat exchanger 64 may be located in a vertical direction.

The outdoor heat exchanger 60 may further include refrigerant pipes 66 each defining the stage and forming the refrigerant flow path of each of the heat exchangers 61, 62, 63 and 64 and a coupling plate 65 supporting the refrigerant pipes 66.

The coupling plate 65 may extend in the vertical direction.

A plurality of refrigerant pipes 66 is provided and disposed to be spaced apart from each other. The plurality of refrigerant pipes 66 may be bent and extended in one direction. Accordingly, a plurality of refrigerant flow paths may be formed in the plurality of heat exchangers 61, 62, 63 and 64 according to connection combination of the plurality of refrigerant pipes 66.

The air conditioner may further include a header 80 connected to the outdoor heat exchanger 60 to combine or branch refrigerant according to operation mode.

The header 80 may further include a plurality of header connection pipes extending to the outdoor heat exchanger 60. The refrigerant may flow in the header 80 and the outdoor heat exchanger 60 through the header connection pipes.

In heating operation, the inlet of the outdoor heat exchanger 60 is connected with flow pipes 91*a*, 91*b*, 92*a*, 92*b*, 93*a* and 94*b* and the outlet of the outdoor heat exchanger 60 is connected with the header connection pipes and the header 80.

The header 80 may be provided with a check valve 81 for guiding unidirectional flow of refrigerant. Specifically, the check valve 81 may be provided in the header 80 such that flow of the refrigerant between the header connection pipe connected to the fourth heat exchanger 64 and the header connection pipes connected to the first to third heat exchanger 63 is controlled.

The air conditioner may further include a discharge pipe 21 for guiding the refrigerant discharged from the compressor 10 to the flow switching unit 20, an indoor connection pipe 24 extending from the flow switching unit 20 to an indoor heat exchanger (not shown), and an outdoor connection pipe 23 extending from the flow switching unit 20 to the header 80.

The oil separator 11 may be installed in the discharge pipe 21.

The discharge pipe 31 may guide the refrigerant passing through the oil separator 11, that is, the high-temperature, high-pressure compressed refrigerant discharged from the compressor 10, to the flow switching unit 20.

The outdoor connection pipe 23 may extend from the flow switching unit 20 to the header 80. Accordingly, the outdoor connection pipe 23 may guide the refrigerant between the flow switching unit 20 and the outdoor heat exchanger 60.

The indoor connection pipe 24 may guide the refrigerant between the flow switching unit 20 and the indoor heat exchanger (not shown).

The air conditioner may further include a refrigerant flow channel 35 extending from the indoor heat exchanger 30 toward the outdoor heat exchanger 60.

The refrigerant flow channel 35 may extend on one side of the indoor heat exchanger. The refrigerant flow channel 35 may extend from the outlet of the indoor heat exchanger in heating operation. At this time, an indoor connection pipe 24 may be connected to the other side of the indoor heat exchanger.

The refrigerant flow channel 35 may be provided with an internal heat exchanger 33. The internal heat exchanger 33 may receive and separate the condensed refrigerant into liquid refrigerant and gaseous refrigerant through heat exchange and supercool the liquid refrigerant. In addition, the internal heat exchanger 33 may perform a function for allowing the gaseous refrigerant to directly flow into the compressor 10 according to the load of the compressor 10.

The air conditioner may further include flow pipes 41, 42, 43 and 44 branched from the refrigerant flow channel 35.

In heating operation, the flow pipes 41, 42, 43 and 44 may be branched such that the refrigerant is branched from the refrigerant flow channel 35 in correspondence with the plurality of heat exchangers 61, 62, 63 and 64.

That is, the plurality of flow pipes 41, 42, 43 and 44 corresponding in number to the number of stages of the outdoor heat exchanger 60 may be formed. For example, the flow pipes 41, 42, 43 and 44 may include the first flow pipe 41, the second flow pipe 42, the third flow pipe 43 and the fourth flow pipe 44.

The first flow pipe 41 may extend from the refrigerant flow channel 35 to the first heat exchanger 61. The second flow pipe 42 may extend from the refrigerant flow channel 35 to the second heat exchanger 62. The third flow pipe 43 may extend from the refrigerant flow channel 35 to the third heat exchanger 63. The fourth flow pipe 44 may extend from the refrigerant flow channel 35 to the fourth heat exchanger 64.

In addition, the expansion valves 51, 52, 53 and 54 may be provided in the flow pipes 41, 42, 43 and 44.

Specifically, the expansion valves 51, 52, 53 and 54 may include the first expansion valve 51 provided in the first flow pipe 41, the second expansion valve 52 provided in the second flow pipe 42, the third expansion valve 53 provided in the third flow pipe 43 and the fourth expansion valve 54 provided in the fourth flow pipe 44.

Meanwhile, the fourth flow pipe 44 may be provided with a passage flow channel 44*a* connected to the fourth expansion valve 54 in parallel. A passage check valve 44*b* is provided in the passage flow channel 44*b* to guide unidirectional flow of the refrigerant.

The passage flow channel 44*a* may be provided such that the refrigerant passing through the fourth heat exchanger 64 flows into the refrigerant flow channel 35 without being depressurized in heating operation.

The air conditioner may further include distributors 46, 47, 48 and 49 provided in the flow pipes 41, 42, 43 and 44.

The distributors 46, 47, 48 and 49 may guide the refrigerant to be branched or combined. For example, in heating operation, the refrigerant flowing into the flow pipes 41, 42, 43 and 44 may be branched into a plurality of paths.

One sides of the distributors 46, 47, 48 and 49 may be connected to the flow pipes 41, 42, 43 and 44. The other sides of the distributors 46, 47, 48 and 49 may be connected to distribution pipes 46*a*.

The distribution pipes 46*a*, 47*a*, 48*a* and 49*a* may extend to flow pipes 91*a*, 91*b*, 92*a*, 92*b*, 93*a*, 94*b*, 94*a* and 94*b* connected to the plurality of heat exchangers 61, 62, 63 and 64.

In heating operation, the distributors 46, 47, 48 and 49 may be located on the downstream side of the expansion valves 51, 52, 53 and 54. Accordingly, the refrigerant expanded by the expansion valves 51, 52, 53 and 54 may flow to the plurality of heat exchangers 61, 62, 63 and 64 through the distributors 46, 47, 48 and 49.

The distributors 46, 47, 48 and 49 may include the first distributor 46 provided in the first flow pipe 41, the second distributor 47 provided in the second flow pipe 42, the third distributor 68 provided in the third flow pipe 43 and the fourth distributor 49 provided in the fourth flow pipe 44, The first distributor 46 may connect the plurality of distribution pipes 46*a*. For example, in heating operation, the plurality of distribution pipes 46*a* for guiding the refrigerant may be connected to the outlet of the first distributor 46.

In addition, the plurality of distribution pipes 46*a* connected such that the refrigerant is branched from the first distributor 46 may be connected to the inlet of the refrigerant pipes 66 forming the plurality of refrigerant flow paths formed in the first heat exchanger 61. Specifically, the plurality of distribution pipes 46*a* may extend to the flow pipes 91*a* and 91*b* to guide the refrigerant such that the refrigerant flows into the refrigerant flow path of the first heat exchanger 61.

Similarly, the second to fourth distributors 47, 48 and 49 may connect the plurality of distribution pipes 47*a*, 48*a* and 49*a*. For the distribution pipes 47*a*, 48*a* and 49*a* connected to the second to fourth distributors 47, 48 and 49, refer to the description of the distribution pipes 46*a* connected to the first distributor 46.

The air conditioner may further include a controller (not shown) for controlling the configuration thereof according to the operation mode.

The controller may control the configuration of the air conditioner through a control command to control the operation mode such as cooling operation, heating operation and defrosting operation. For example, the controller 200 may control the flow switching unit 20 to determine the flow direction of the refrigerant, for cooling operation or heating operation. In addition, the controller 200 may control the expansion valves 51, 52, 53 and 54 and bypass valves 96, 97, 98 and 99 to perform defrosting operation, thereby continuously heating an indoor space.

When heating operation is performed, frost may be formed on the outdoor heat exchanger 60 due to an outside temperature. For defrosting, the controller may control the plurality of heat exchangers 61, 62, 63 and 64 to sequentially perform defrosting operation.

That is, the controller may perform control such that the plurality of heat exchangers alternately performs defrosting operation. For example, upon determining that defrosting operation of the fourth heat exchanger 64 is necessary, the controller may perform control such that the first to third heat exchangers 61, 62 and 63 perform heating operation and only the fourth heat exchanger 64 performs defrosting operation. Therefore, it is possible to provide appropriate heating performance (75% or more) to the user in the indoor space.

Meanwhile, when any one of the plurality of heat exchangers performs defrosting operation, since a heat exchanger adjacent to the heat exchanger for performing defrosting operation performs heating operation, frost may be formed on an interface between the two heat exchangers due to a temperature difference therebetween. That is, a frost band may be formed on the interface between the heat exchangers.

Since the conventional air conditioner does not have a means for defrosting the interface, when a frost band is formed on the interface, the frost band is left undone or is removed by performing control such that all the outdoor heat exchangers perform defrosting operation.

At this time, when all the outdoor heat exchangers perform defrosting operation, cooling operation is substantially performed and thus the indoor space in which the user is located is not heated, thereby decreasing reliability of the air conditioner.

In the air conditioner according to the embodiment of the present invention, it is possible to remove the frost bands which may be generated on the interfaces B1, B2 and b3 between the plurality of heat exchangers 61, 62, 63 and 64 in defrosting operation and to maintain heating performance at an appropriate level (75% or more) to provide heating to the user.

Hereinafter, this will be described in detail.

The air conditioner may further include a bypass pipe 90 for branching the relatively high-temperature, high-pressure refrigerant discharged from the compressor 10 through the discharge pipe 21 and flow pipes 91*a*, 91*b*, 92*a*, 92*b*, 93*a*, 93*b*, 94*a* and 94*b* branched from the bypass pipe 90 and extending to the refrigerant pipes 66 provided in the plurality of heat exchangers 61, 62, 63 and 64.

The bypass pipe 90 may be branched at one point of the discharge pipe 21 and extended toward the plurality of heat exchangers 61, 62, 63 and 64.

By the bypass pipe 90, the compressed refrigerant (hot gas) flowing through the discharge pipe 21 may be branched. The branched compressed refrigerant (hot gas) may flow into the bypass pipe 90 and then flow into the flow pipes 91*a*, 91*b*, 92*a*, 92*b*, 93*a*, 93*b*, 94*a* and 94*b*. Accordingly, the controller may perform control such that the branched compressed refrigerant flows into a heat exchanger, which needs to perform defrosting operation, among the plurality of heat exchangers 61, 62, 63 and 64, thereby performing defrosting operation.

That is, the compressed refrigerant (hot gas) flowing into the bypass pipe 90 may be provided to the heat exchanger 61, 62, 63 or 64, which needs to perform defrosting operation, among the plurality of heat exchangers 61, 62, 63 and 64.

The bypass pipe 90 may include a plurality of bypass pipes corresponding to the plurality of heat exchangers 61, 62, 63 and 64. For example, the bypass pipe 90 may be branched into and extended to the heat exchanger forming a single stage.

Specifically, the bypass pipe 90 may include the first bypass pipe 91 extending toward the first heat exchanger 61, the second bypass pipe 92 branched from the first bypass pipe 91 and extending toward the second heat exchanger 62, the third bypass pipe 93 branched from the first bypass pipe 91 and extending toward the third heat exchanger 63, and the fourth bypass pipe 94 branched from the first bypass pipe 91 and extending to the fourth heat exchanger 64.

The first to fourth bypass pipes 91, 92, 93 and 94 may include bypass valves 96, 97, 98 and 99 for controlling flow of the refrigerant. Each of the bypass valves 96, 97, 98 and 99 may include a solenoid valve (SV), an electronic expansion valve (EEV), etc.

Specifically, the first bypass pipe 91 may include the first bypass valve 96 for controlling flow of the refrigerant. The second bypass pipe 92 may include the second bypass valve 97 for controlling flow of the refrigerant. The third bypass pipe 93 may include the third bypass valve 98 for controlling flow of the refrigerant. The fourth bypass pipe 94 may include the fourth bypass valve 98 for controlling flow of the refrigerant.

In this case, the flow pipes 91*a*, 91*b*, 92*a*, 92*b*, 93*a*, 93*b*, 94*a* and 94*b* may be branched from the first to fourth bypass pipes 91, 92, 93 and 94 and extended to the first to fourth heat exchangers 61, 62, 63 and 64, respectively.

For example, the first bypass pipe 91 may be connected with a plurality of flow pipes 91*a* and 91*b* branched from one end thereof. The plurality of flow pipes 91*a* and 91*b* may extend to the inlets or outlets of the refrigerant pipes 66 forming a plurality of refrigerant flow paths in the first heat exchanger 61.

The flow pipes 91*a*, 91*b*, 92*a*, 92*b*, 93*a*, 93*b*, 94*a* and 94*b* may be formed to correspond to the plurality of refrigerant flow paths provided in the heat exchanger forming any one stage of the plurality of heat exchangers 61, 62, 63 and 64. That is, the flow pipe may be formed of a plurality of pipes branched from the bypass pipe 90. The plurality of flow pipes 91*a*, 91*b*, 92*a*, 92*b*, 93*a*, 93*b*, 94*a* and 94*b* may extend to the inlets or outlets of the plurality of refrigerant flow paths, thereby guiding the refrigerant.

The flow pipes 91*a*, 91*b*, 92*a*, 92*b*, 93*a*, 93*b*, 94*a* and 94*b* may include the first flow pipes 91*a* and 91*b* branched from the first bypass pipe 91, the second flow pipes 92*a* and 92*b* branched from the second bypass pipe 92, the third flow pipes 93*a* and 93*b* branched from the third bypass pipe 93, and the fourth flow pipes 94*a* and 94*b* branched from the fourth bypass pipe 94.

The first flow pipes 91*a* and 91*b* may extend to the refrigerant pipes 66 provided in the vertical direction of the first heat exchanger 61.

More specifically, the first flow pipes 91*a* and 91*b* may extend from the first bypass pipe 95 to one end of the refrigerant pipe 66 forming any one refrigerant flow path in the first heat exchanger 61.

Since a plurality of refrigerant flow paths is provided in the first heat exchanger 61 in the vertical direction, the plurality of first flow pipes 91*a* and 91*b* may be provided in correspondence with the refrigerant flow paths.

The first flow pipes 91*a* and 91*b* may include the first upper flow pipe 91*a* extending to the refrigerant flow path located on the uppermost side of the first heat exchanger 61 and the first lower flow pipe 92*b* extending to the refrigerant flow path located on the lowermost side of the first heat exchanger 61.

That is, the first upper flow pipe 91*a* may be connected to the refrigerant pipe 66 forming the refrigerant flow path located on the uppermost end of the first heat exchanger 61. In addition, the first lower flow pipe 91*b* may be connected to the refrigerant pipe 66 forming the refrigerant flow path located on the lowermost end of the first heat exchanger 61.

In addition, the first flow pipes 91*a* and 91*b* may be connected with the distribution pipes 46*a*. For example, the first upper flow pipe 91*a* may be connected with the uppermost distribution pipe 46*a* among the plurality of distribution pipes extending from the distributor 46 such that the refrigerant is branched and combined.

The second flow pipes 92*a* and 92*b* may extend to the refrigerant pipes 66 provided in the vertical direction of the second heat exchanger 62. The second flow pipes 92*a* and 92*b* may include the second upper flow pipe 92*a* extending to the refrigerant flow path located on the uppermost side of the second heat exchanger 62 and the second lower flow pipe 92*b* extending to the refrigerant flow path located on the lowermost side of the second heat exchanger 62.

The third flow pipes 93*a* and 93*b* may extend to the refrigerant pipes 66 provided in the vertical direction of the third heat exchanger 63. The third flow pipes 93*a* and 93*b* may include the third upper flow pipe 93*a* extending to the refrigerant flow path located on the uppermost side of the third heat exchanger 63 and the third lower flow pipe 93*b* extending to the refrigerant flow path located on the lowermost side of the third heat exchanger 63.

The fourth flow pipes 94*a* and 94*b* may extend to the refrigerant pipes 66 provided in the vertical direction of the fourth heat exchanger 64. The fourth flow pipes 94*a* and 94*b* may include the fourth upper flow pipe 94*a* extending to the refrigerant flow path located on the uppermost side of the fourth heat exchanger 64 and the fourth lower flow pipe 94*b* extending to the refrigerant flow path located on the lowermost side of the fourth heat exchanger 64.

The configurations of the first to fourth flow pipes are the same except for the heat exchangers 61, 62, 63 and 64.

Accordingly, for the second to fourth flow pipes, refer to the description of the first flow pipes 91*a* and 91*b*.

The air conditioner may further include overlap pipes 101, 102 and 103 branched from the flow pipes 91*a*, 91*b*, 92*a*, 92*b*, 93*a*, 93*b*, 94*a* and 94*b* connected to any one of the plurality of heat exchangers 61, 62, 63 and 64 and extending to the flow pipes 91*a*, 91*b*, 92*a*, 92*b*, 93*a*, 93*b*, 94*a* and 94*b* connected to another heat exchanger.

The overlap pipes 101, 102 and 103 may connect the uppermost or lowermost flow pipes 91*a*, 91*b*, 92*a*, 92*b*, 93*a*, 93*b*, 94*a* and 94*b* connected to any one of the plurality of heat exchangers 61, 62, 63 and 64 with the lowermost or uppermost flow pipes 91*a*, 91*b*, 92*a*, 92*b*, 93*a*, 93*b*, 94*a* and 94*b* connected to another heat exchanger.

The overlap pipes 101, 102 and 103 may include the first overlap pipe 101 for connecting the first flow pipe and the second flow pipe such that the refrigerant flows, the second overlap pipe 102 for connecting the second flow pipe and the third flow pipe such that the refrigerant flows, and the third overlap pipe 103 for connecting the third flow pipe and the fourth flow pipe such that the refrigerant flows.

The first overlap pipe 101 may be branched at one point of the first flow pipe extending to the first heat exchanger 61 and extended to one point of the second flow pipe extending to the second heat exchanger 62. Specifically, the first overlap pipe 101 may be branched from the first lower flow pipe 91*b* and extended to the second upper flow pipe 92*a*.

That is, the first overlap pipe 101 may connect the first lower flow pipe 91*b* and the second upper flow pipe 92*a*. Accordingly, the refrigerant flowing through the first lower flow pipe 91*b* may flow into the second upper flow pipe 92*a* and the refrigerant flowing through the second upper flow pipe 92*a* may flow into the first lower flow pipe 91*b*.

At this time, the distribution pipes 46*a* extending from the first distributor 46 may extend from the first lower flow pipe 91*b* to be connected between the first overlap pipe 101 and the first bypass valve 96.

The second overlap pipe 102 may be branched at another point of the second flow pipe extending to the second heat exchanger 62 and extended to one point of the third flow pipe extending to the third heat exchanger 63. Specifically, the second overlap pipe 102 may be branched from the second lower flow pipe 92*b* and extended to the third upper flow pipe 93*a*.

That is, the second overlap pipe 102 may connect the second lower flow pipe 92*b* and the third upper flow pipe 93*a*. Accordingly, the refrigerant flowing through the second lower flow pipe 92*b* may flow into the third upper flow pipe 93*a* and the refrigerant flowing through the third upper flow pipe 93*a* may flow into the second lower flow pipe 92*b*.

At this time, the distribution pipes 47*a* extending from the second distributor 47 may extend from the second upper flow pipe 92*a* to be connected between the first overlap pipe 101 and the second bypass valve 97, and extend from the second lower flow pipe 92*b* to be connected between the second overlap pipe 102 and the second bypass valve 97.

The third overlap pipe 103 may be branched from another point of the third flow pipe extending to the third heat exchanger 63 and extended to one point of the fourth flow pipe extending to the fourth heat exchanger 64. Specifically, the third overlap pipe 103 may be branched from the third lower flow pipe 93*b* and extended to the fourth upper flow pipe 94*a*.

That is, the third overlap pipe 103 may connect the third lower flow pipe 93*b* and the fourth upper flow pipe 94*a*. Accordingly, the refrigerant flowing through the third lower flow pipe 93*b* may flow into the fourth upper flow pipe 94*a* and the refrigerant flowing through the fourth upper flow pipe 94*a* may flow into the third lower flow pipe 93*b*.

At this time, the distribution pipes 48*a* extending from the third distributor 48 may extend from the third upper flow pipe 93*a* to be connected between the second overlap pipe 102 and the third bypass valve 98 and extend from the third lower flow pipe 93*b* to be connected between the third overlap pipe 103 and the third bypass valve 98.

In addition, the distribution pipes 49 extending from the fourth distributor 49 may extend from the fourth upper flow pipe 94*a* to be connected between the third overlap pipe 103 and the fourth bypass valve 99.

The air conditioner may further include overlap valves 106, 107 and 108 provided in the overlap pipes 101, 102 and 103 to control flow of the refrigerant.

The overlap valves 106, 107 and 108 may include the first overlap valve 106 provided in the first overlap pipe 101, the second overlap valve 107 provided in the second overlap pipe 102, and the third overlap valve 108 provided in the third overlap pipe 103.

The first to third overlap valves 106, 107 and 108 may be independently opened or closed by the controller.

According to the overlap pipes 101, 102 and 103 and the overlap valves 106, 107 and 108, the high-temperature compressed refrigerant flowing through the bypass pipe 90 when defrosting operation is performed may flow into the uppermost or lowermost refrigerant flow path of another upper or lower heat exchanger for performing heating operation.

Accordingly, it is possible to remove or prevent the frost band which may be formed on the interface B1 between the first heat exchanger 61 and the second heat exchanger 62, the interface B2 between the second heat exchanger 62 and the third heat exchanger 63 and the interface B3 between the third heat exchanger 63 and the fourth heat exchanger 64.

For example, when the fourth heat exchanger 64 performs defrosting operation, the controller may determine whether a frost band is formed on the interface B3 between the third heat exchanger 63 and the fourth heat exchanger 64. Upon determining that the frost band is formed, the controller may open the third overlap valve 108 such that the high-temperature refrigerant flows in the lowermost refrigerant path of the third heat exchanger 63 along the third overlap pipe 103. At this time, the third heat exchanger 63 may perform heating operation, but the temperature of the refrigerant may increase by the high-temperature refrigerant flowing into the lowermost refrigerant flow path. As a result, a difference in temperature between the lower end of the third heat exchanger 63 and the upper end of the fourth heat exchanger 64 may be reduced, thereby removing or preventing the frost band.

The air conditioner may further include an outside temperature sensor (not shown) and internal temperature sensors 85, 86, 87 and 88.

The outside temperature sensor may detect the outside temperature and provide the detected information to the controller.

The internal temperature sensors 85, 86, 87 and 88 may be provided in the outdoor heat exchanger 60. Specifically, the internal temperature sensors 85, 86, 87 and 88 may be respectively provided in the plurality of heat exchangers 61, 62, 63 and 64 to detect the temperature of the refrigerant flowing in one stage. In addition, the information detected by the internal temperature sensors 85, 86, 87 and 88 may be transmitted to the controller.

The internal temperature sensors 85, 86, 87 and 88 may include the first internal temperature sensor 85 provided in the first heat exchanger 61, the second internal temperature sensor 86 provided in the second heat exchanger 62, the third internal temperature sensor 87 provided in the third heat exchanger 63 and the fourth internal temperature sensor 88 provided in the fourth heat exchanger 64.

The controller may determine whether frost is formed on the plurality of heat exchangers 61, 62, 63 and 64 and whether frost is formed on interfaces B1, B2 and B3 between adjacent heat exchangers based on the information detected by the outside temperature sensor and the internal temperature sensors 85, 86, 87 and 88. In addition, the controller may perform control to perform defrosting operation of the heat exchanger, on which frost is determined to be formed, and perform control to remove the frost band.

For example, when the outside temperature is 0° C. and the temperature detected by the internal temperature sensors 85, 86, 87 and 88 is less than −7° C., the controller may perform control to perform defrosting operation of the heat exchangers 61, 62, 63 and 64 provided with the internal temperature sensors. Accordingly, the controller may perform control such that the plurality of heat exchangers 61, 62, 63 and 64 alternately performs defrosting operation.

In addition, when the difference in temperature between adjacent heat exchangers 61, 62, 63 and 64 exceeds a predetermined value, the controller may open the overlap valves 106, 107, 108 and 109, thereby preventing or removing the frost band.

For example, the controller may determine that the frost band is formed when the difference between the temperature detected by the heat exchanger 61, 62, 63 or 64 for performing defrosting operation and the temperature detected by another heat exchanger 61, 62, 63 or 64 adjacent thereto in the vertical direction exceeds the predetermined value, and perform control to open the overlap valve 106, 107, 108 or 109 of the overlap pipe 101, 102, 103 or 104 connected to the adjacent heat exchanger 61, 62, 63 or 64.

The predetermined value may be understood as a temperature difference forming an environmental condition in which frost may be formed on the interfaces B1, B2 and B3.

Here, the difference in temperature between adjacent heat exchangers may be understood as a difference in temperature at the portions B1, B2 and B3 forming the boundary with the upper or lower heat exchanger of the plurality of heat exchangers 61, 62, 63 and 64 disposed in the vertical direction. For example, this may be understood as the temperature difference at the interface B1 between the first heat exchanger 61 and the second heat exchanger 62 or the temperature difference at the interface B2 between the second heat exchanger 62 and the third heat exchanger 63 or the temperature difference at the interface B3 between the third heat exchanger 63 and the fourth heat exchanger 64.

Figure 3:
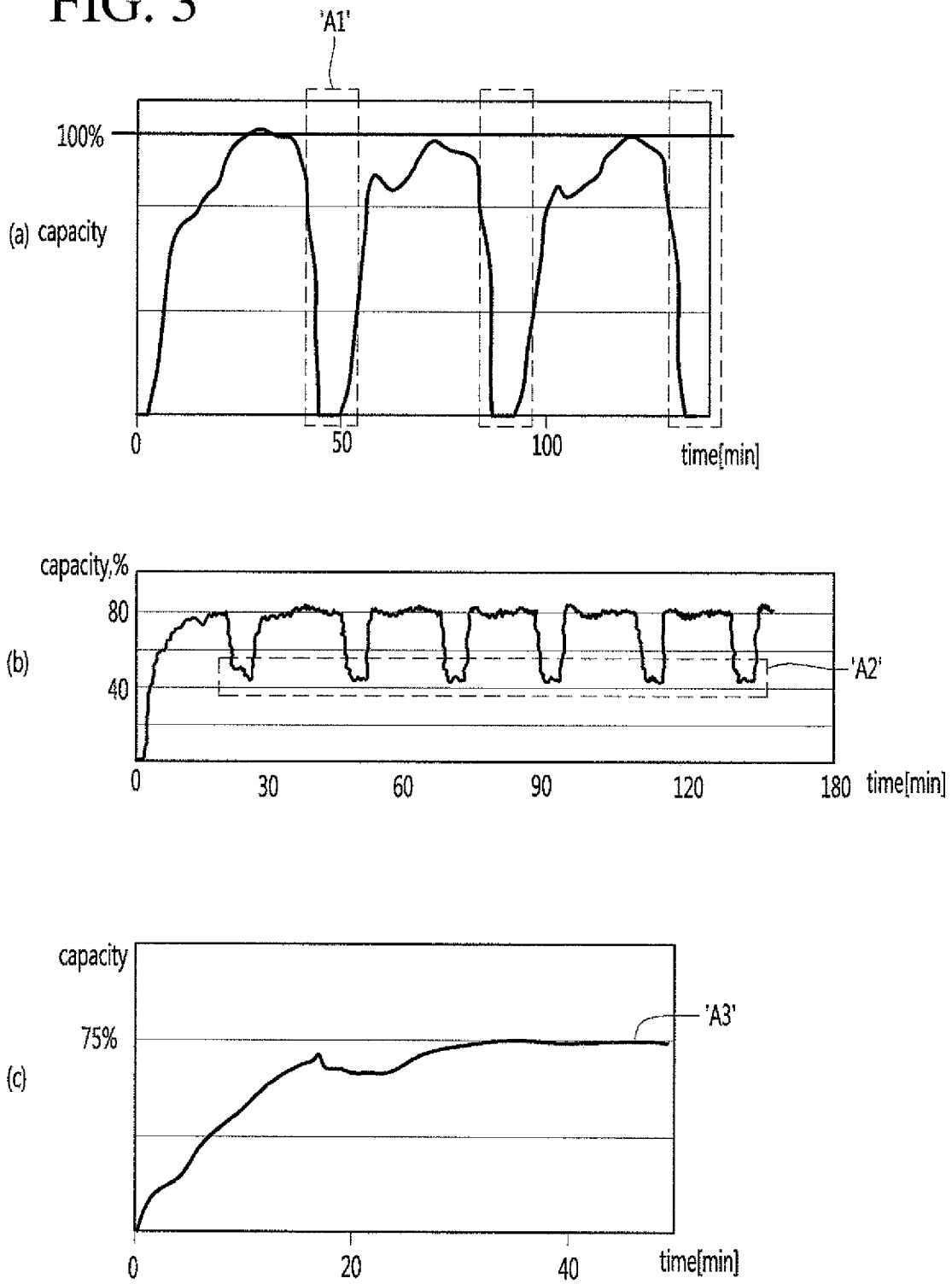
FIG. 3 is graphs showing experimental results of comparing heating capacities of a conventional air conditioner and the air conditioner according to the embodiment of the present invention.

FIG. 3 is graphs showing experimental results of comparing heating capacities of a conventional air conditioner and the air conditioner according to the embodiment of the present invention.

Specifically, FIG. 3(*a*) is a graph showing a whole defrosting operation area A1 in which all the outdoor heat exchangers are switched to cooling operation at the time of defrosting operation because divisional operation of each stage of the conventional air conditioner is impossible, FIG. 3(*b*) is a graph showing a defrosting operation area A2 in the outdoor heat exchanger provided with a 2-stage heat exchanger, and FIG. 3(*c*) is a graph showing heating capacity A3 when defrosting operation is performed in the outdoor heat exchanger of the air conditioner according to the embodiment of the present invention.

Referring to FIG. 3(*a*), the heating capacity in the whole defrosting operation area A1 in which defrosting operation is performed is lowered from total heating capacity to a level close to about 0%, because the operation mode is switched to the cooling operation. Therefore, even when heating operation is performed, it is impossible to provide appropriate heating to the user in the indoor space.

Referring to FIG. 3(*b*), the heating capacity in the partial defrosting operation area A2 in which any one heat exchanger performs defrosting operation in the outdoor heat exchanger provided with the two-stage heat exchanger is lowered from total heating capacity to about 45%. Therefore, it is impossible to provide appropriate heating (75%) to the user in the indoor space.

Here, the appropriate heating capacity of the user may be defined as 75% of the total heating capacity.

In contrast, referring to FIG. 3(*c*), the defrosting operation of the air conditioner according to the embodiment of the present invention can continuously heat the indoor space as defrosting operation of the first to fourth heat exchangers 61, 62, 63 and 64 is alternately performed, and maintain an appropriate heating level (75%).

In addition, when defrosting operation is performed, the frost band may be formed on the interfaces B1, B2 and B3 between the plurality of heat exchangers due to a difference in temperature therebetween. However, it is possible to remove or prevent the frost band by the overlap pipes 101, 102 and 103 and the overlap valves 106, 107 and 108. Accordingly, it is possible to further increase heating performance.

The present invention has the following effects.

First, it is possible to minimize a phenomenon wherein an inside temperature decreases when defrosting operation is performed. That is, it is possible to provide satisfactory heating performance to a user even at the time of defrosting operation. Accordingly, it is possible to improve reliability of the air conditioner.

In addition, even in defrosting operation, it is possible to maintain heating performance (capacity) of 75% or more.

In addition, it is possible to minimize reduction of heating performance by defrosting operation as the number of an outer heat exchanger increases.

In addition, when defrosting operation is performed, since a difference in temperature between the plurality of heat exchangers configuring the outdoor heat exchanger may be reduced, it is possible to prevent a frost band from being formed. Accordingly, it is possible to improve defrosting performance and heating performance.

In addition, the heat exchangers may selectively perform defrosting operation through control of a hot gas valve. That is, it is possible to continuously heat an indoor space.

Embodiments provide an air conditioner capable of minimizing decrease in heating performance when defrosting operation is performed, and a method of controlling the same.

Embodiments provide an air conditioner capable of continuously heating an indoor space when defrosting operation is performed, and a method of controlling the same.

Embodiments provide an air conditioner capable of preventing a frost band from being formed on an interface between heat exchangers when defrosting operation is performed in an outdoor heat exchanger including a plurality of heat exchangers stacked in multiple stages, and a method of controlling the same.

In one embodiment, an air conditioner includes a plurality of heat exchangers provided to form an internal refrigerant flow path of an outdoor heat exchanger in multiple stages, a bypass pipe configured to branch refrigerant discharged from a compressor and to guide the refrigerant to the plurality of heat exchangers, flow pipes branched from the bypass pipe and extending to refrigerant pipes provided in the plurality of heat exchangers, and overlap pipes branched from a flow pipe connected to any one of the plurality of heat exchangers and extending to a flow pipe connected to another heat exchanger. Therefore, it is possible to prevent frost from being formed between adjacent heat exchangers among the plurality of heat exchangers.

In addition, the plurality of heat exchangers may alternately perform defrosting operation. Therefore, even when defrosting operation is performed, it is possible to continuously heat an indoor space.

The plurality of heat exchangers may be integrally formed.

The plurality of heat exchangers may be stacked in a vertical direction.

The plurality of heat exchangers may include four heat exchangers and may form a multi-stage refrigerant flow path. That is, the plurality of heat exchangers may include a first heat exchanger, a second heat exchanger, a third heat exchanger and a fourth heat exchanger. Therefore, even when defrosting operation is performed during heating operation, it is possible to maintain 75% or more of maximum heating performance.

Meanwhile, the air conditioner according to the embodiment of the present invention may include an overlap pipe configured to connect a lowermost flow pipe of the first heat exchanger and an uppermost flow pipe of the second heat exchanger located below the first heat exchanger. Therefore, it is possible to prevent frost from being formed on an interface between the first heat exchanger and the second heat exchanger.

In another aspect, the air conditioner according to the embodiment of the present invention may include an overlap pipe branched from an uppermost or lowermost flow pipe extending to any one of the plurality of heat exchangers and extending to a lowermost or uppermost flow pipe of a heat exchanger adjacent thereto. Therefore, it is possible to prevent a frost band from being formed between the adjacent heat exchangers.

In addition, an overlap valve may be provided in the overlap pipe to control flow of the refrigerant. Therefore, it is possible to prevent high-temperature refrigerant discharged from the compressor from unnecessarily flowing.

The air conditioner according to the embodiment of the present invention may further include a bypass pipe configured to guide the refrigerant discharged from the compressor such that the refrigerant flows into the outdoor heat exchanger. Therefore, the high-temperature refrigerant flowing through the bypass pipe may selectively flow into the plurality of heat exchangers configuring the outdoor heat exchanger, thereby performing defrosting operation.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioner comprising:

a compressor configured to compress refrigerant;

an outdoor heat exchanger provided with a plurality of heat exchangers to form an internal refrigerant flow path in multiple stages;

a bypass pipe configured to branch the refrigerant discharged from the compressor;

a plurality of bypass tubes branched from the bypass pipe and extending to the plurality of heat exchangers, respectively, and each of the plurality of bypass tubes comprising a bypass valve, respectively;

flow pipes branched from the plurality of bypass tubes and extending to refrigerant pipes provided in the plurality of heat exchangers; and overlap pipes branched from one of the flow pipes connected to any one of the plurality of heat exchangers and extending to another one of the flow pipes connected to another heat exchanger of the plurality of heat exchangers.

2. The air conditioner of claim 1, further comprising overlap valves provided in the overlap pipes.

3. The air conditioner of claim 1, wherein the flow pipes extend to the refrigerant pipes provided to respectively form a plurality of refrigerant flow paths in the plurality of heat exchangers.

4. The air conditioner of claim 1, wherein the overlap pipes connect an uppermost or lowermost flow pipe of the flow pipes connected to any one of the plurality of heat exchangers and a lowermost or uppermost flow pipe of the flow pipes connected to another heat exchanger of the plurality of heat exchangers.

5. The air conditioner of claim 1, further comprising:

a refrigerant flow channel connected to an indoor heat exchanger;

a flow tube branched from the refrigerant flow channel;

a distributor provided in the flow tube; and a plurality of distribution pipes extending from the distributor to the flow pipe such that the refrigerant flowing into the distributor is branched.

6. The air conditioner of claim 1, further comprising:

an outside temperature sensor configured to detect an outside temperature;

an internal temperature sensor configured to detect a temperature of the refrigerant flowing in the plurality of heat exchangers to determine whether frost is formed; and a controller configured to control whether or not to perform a defrosting operation based on information detected by the outside temperature sensor and the internal temperature sensor.

7. The air conditioner of claim 6, wherein the controller performs control such that the plurality of heat exchangers alternately performs the defrosting operation.

8. The air conditioner of claim 6, wherein the controller opens the overlap valves when a difference in temperature between an adjacent two of the plurality of heat exchangers exceeds a predetermined value.

9. The air conditioner of claim 1, wherein the plurality of heat exchangers includes:

a first heat exchanger; and a second heat exchanger located below the first heat exchanger.

10. The air conditioner of claim 9, wherein the overlap pipes include a first overlap pipe configured to connect a lowermost flow pipe of the flow pipes extending to the first heat exchanger and an uppermost flow pipe of the flow pipes extending to the second heat exchanger.

11. The air conditioner of claim 10, wherein the plurality of heat exchangers includes:

a third heat exchanger located below the second heat exchanger, and a fourth heat exchanger located below the third heat exchanger.

12. The air conditioner of claim 11, wherein the overlap pipes include:

a second overlap pipe configured to connect a lowermost flow pipe of the flow pipes extending to the second heat exchanger and an uppermost flow pipe of the flow pipes extending to the third heat exchanger; and a third overlap pipe configured to connect a lowermost flow pipe of the flow pipes extending to the third heat exchanger and an uppermost flow pipe of the flow pipes extending to the fourth heat exchanger.

13. The air conditioner of claim 12, wherein the plurality of heat exchangers is stacked in a vertical direction and is integrally formed.

14. An air conditioner, comprising:

a compressor configured to compress refrigerant;

an outdoor heat exchanger provided with a plurality of heat exchangers to form an internal refrigerant flow path in multiple stages;

a bypass pipe configured to branch the refrigerant discharged from the compressor;

a plurality of bypass tubes branched from the bypass pipe and extending to the plurality of heat exchangers, respectively, and each of the plurality of bypass tubes comprising a bypass valve, respectively;

flow pipes branched from the plurality of bypass tubes and extending to refrigerant pipes provided in the plurality of heat exchangers; and overlap pipes branched from one of the flow pipes of each of the plurality of heat exchangers and extending to one of the flow pipes of another heat exchanger of the plurality of heat exchangers, the overlap pipes being adjacent interfaces between the plurality of heat exchangers, wherein when refrigerant flows through one of the overlap pipes during a defrosting operation, frost at a corresponding interface between the plurality of heat exchangers is removed or prevented.

15. The air conditioner of claim 14, further comprising overlap valves provided in the overlap pipes.

16. The air conditioner of claim 14, wherein the overlap pipes connect an uppermost or lowermost flow pipe of the flow pipes connected to each of the plurality of heat exchangers and a lowermost or uppermost flow pipe of the flow pipes connected to another heat exchanger of the plurality of heat exchangers.

17. The air conditioner of claim 1, further comprising:

an outside temperature sensor configured to detect an outside temperature;

an internal temperature sensor configured to detect a temperature of the refrigerant flowing in the plurality of heat exchangers to determine whether frost is formed; and a controller configured to control whether or not to perform a defrosting operation based on information detected by the outside temperature sensor and the internal temperature sensor, wherein the controller performs control such that the plurality of heat exchangers alternately performs the defrosting operation.

18. The air conditioner of claim 17, wherein the controller opens the overlap valves when a difference in temperature between an adjacent two of the plurality of heat exchangers exceeds a predetermined value.

19. An air conditioner, comprising:

a compressor configured to compress refrigerant;

an outdoor heat exchanger provided with a plurality of heat exchangers to form an internal refrigerant flow path in multiple stages;

a bypass pipe configured to branch the refrigerant discharged from the compressor;

a plurality of bypass tubes branched from the bypass pipe and extending to the plurality of heat exchangers, respectively, and each of the plurality of bypass tubes comprising a bypass valve, respectively;

flow pipes branched from the plurality of bypass tubes and extending to refrigerant pipes provided in the plurality of heat exchangers; and overlap pipes branched from one of the flow pipes connected to any one of the plurality of heat exchangers and extending to another one of the flow pipes connected to another heat exchanger of the plurality of heat exchangers, wherein the plurality of heat exchangers includes:

a first heat exchanger;

a second heat exchanger located below the first heat exchanger;

a third heat exchanger located below the second heat exchanger;

a fourth heat exchanger located below the third heat exchanger, wherein the overlap pipes include:

a first overlap pipe configured to connect a lowermost flow pipe of the flow pipes extending to the first heat exchanger and an uppermost flow pipe of the flow pipes extending to the second heat exchanger;

a second overlap pipe configured to connect a lowermost flow pipe of the flow pipes extending to the second heat exchanger and an uppermost flow pipe of the flow pipes extending to the third heat exchanger; and a third overlap pipe configured to connect a lowermost flow pipe of the flow pipes extending to the third heat exchanger and an uppermost flow pipe of the flow pipes extending to the fourth heat exchanger, and wherein when refrigerant flows through one of the overlap pipes during a defrosting operation, frost at an interface between the plurality of heat exchangers adjacent the one of the overlap pipes is removed or prevented.

20. The air conditioner of claim 19, further comprising overlap valves provided in the overlap pipes.

* * * * *